US007640603B2

(12) United States Patent
Robertson

(10) Patent No.: US 7,640,603 B2
(45) Date of Patent: Jan. 5, 2010

(54) CISTERN OUTLET VALVE MOUNTING BRACKET ASSEMBLY AND A METHOD OF INSTALLING AN OUTLET VALVE IN CISTERN

(75) Inventor: Sam Robertson, Marden (AU)

(73) Assignee: Caroma Industries, Limited, Brisbane, Queensland (AU)

( * ) Notice: Subject to any disclaimer, the term of this patent is extended or adjusted under 35 U.S.C. 154(b) by 698 days.

(21) Appl. No.: 10/527,264

(22) PCT Filed: Aug. 28, 2003

(86) PCT No.: PCT/AU03/01107

§ 371 (c)(1),
(2), (4) Date: Sep. 8, 2005

(87) PCT Pub. No.: WO2004/027171

PCT Pub. Date: Apr. 1, 2004

(65) Prior Publication Data

US 2006/0150308 A1 Jul. 13, 2006

(30) Foreign Application Priority Data

Sep. 19, 2002 (AU) ..... 2002951504

(51) Int. Cl.
*E03D 1/34* (2006.01)

(52) U.S. Cl. ..... 4/378; 285/205; 285/415

(58) Field of Classification Search ..... 4/300, 4/353, 378, 417–420; 285/15, 19, 20, 139.1, 285/139.2, 139.3, 142.1, 148.25, 148.26, 285/193, 205, 206, 208, 412, 415
See application file for complete search history.

(56) References Cited

U.S. PATENT DOCUMENTS

| | | | | | |
|---|---|---|---|---|---|
| 696,603 | A | * | 4/1902 | Smith | 285/413 |
| 803,687 | A | * | 11/1905 | Grotewohl | 285/205 |
| 2,272,197 | A | | 2/1942 | Groeniger | |
| 2,964,758 | A | * | 12/1960 | Graziosi | 4/378 X |
| 5,088,133 | A | | 2/1992 | Chen | |
| 5,755,464 | A | * | 5/1998 | Erwin | 285/415 X |
| 6,192,526 | B1 | | 2/2001 | Nichols-Roy | |

* cited by examiner

*Primary Examiner*—Robert M Fetsuga
(74) *Attorney, Agent, or Firm*—Merchant & Gould P.C.

(57) ABSTRACT

A cistern outlet valve mounting bracket assembly (10). The assembly includes first and second bracket members (12, 14) adapted for positioning about an outlet valve (20) in engagement with each other and the valve (20). The members (12, 14) also have means (28, 32) to allow fixing of the engaged members (12, 14) to a cistern (38). A method of installing an outlet valve (20) in a cistern (38) is also disclosed.

4 Claims, 5 Drawing Sheets

CISTERN OUTLET VALVE MOUNTING BRACKET ASSEMBLY AND A METHOD OF INSTALLING AN OUTLET VALVE IN CISTERN

TECHNICAL FIELD

The present invention relates to a cistern outlet valve mounting bracket assembly and a method of installing an outlet valve in a cistern. A cistern is known as a flush tank in the United States of America.

The invention has been primarily developed for mounting outlet valves in one piece toilet suites (ie. suites that that have an integral cistern and pan) and will be described hereinafter with reference to this application. However, it would be appreciated that the invention is not limited to this particular use and, for example, can also be used in mounting an outlet valve in a separate cistern.

BACKGROUND OF THE INVENTION

Outlet valves must be installed in cisterns in such a manner as to allow their removal for service and repair. In a toilet suite that has a separate cistern and pan, the outlet valve has a threaded tail which passes through an opening in the bottom of the cistern and is fastened thereto by an external nut. A seal is placed in the potential leak path between the cistern interior and the valve. When the nut is unscrewed from the tail, the outlet valve can be removed from the cistern.

In a one piece toilet suite the underside of the cistern is concealed by a shroud that extends from the cistern to the pan. The shroud makes access to the underside of the cistern very difficult, particularly after the suite has been grouted to a bathroom floor.

One known arrangement which avoids having to access the underside of the cistern to remove the outlet valve uses the previously described nut to instead clamp a stainless steel mounting plate to the valve tail, with a seal therebetween. A second seal is then placed on the underside of the mounting plate. The mounting plate, and thus the outlet valve, is then fixed to the cistern via two captive bolts in the base of the cistern that pass through holes in the mounting plate.

This known arrangement has several disadvantages. Firstly, an additional potential leak path is introduced at the second seal between the mounting plate and the cistern. Secondly, the stainless steel plate is expensive to manufacture and time consuming to install. Thirdly, the addition of the mounting plate and the second seal increases the overall height of the outlet valve, which can limit the range of cisterns to which it may be fitted.

OBJECT OF THE INVENTION

It is an object of the present invention to substantially overcome or at least ameliorate one or more of the above prior art disadvantages.

SUMMARY OF THE INVENTION

Accordingly, in a first aspect, the present invention provides a cistern outlet valve mounting bracket assembly, said assembly including first and second bracket members adapted for positioning about an outlet valve in engagement with each other and the valve, said members having means to allow fixing of said engaged members to a cistern.

The members preferably each include a semi-circular recess, each adapted to receive a portion of the outlet valve therein. The recesses preferably have teeth adapted to engage with corresponding openings in the outlet valve.

The members preferably engage at one or more regions, most preferably two, also having said means to allow fixing. Said means to allow fixing are desirably one or more openings in the assembled members that are each adapted to receive a fixing shaft therethrough. In a preferred from, the openings comprise a pair of shaft portions in the first member and a corresponding pair of apertures in the second member, the second member having barbs adapted to engage with the first member. The barbs are preferably adapted to engage with the first member substantially adjacent the shaft portions.

In a second aspect, the present invention provides a method of installing an outlet valve in a cistern, said method including positioning first and second bracket members about the outlet valve and in engagement with each other and the outlet valve and then fixing said engaged members to said cistern.

The members are preferably fixed to the cistern with one or more fixing shafts that pass through corresponding openings in the engaged members.

BRIEF DESCRIPTION OF THE DRAWINGS

A preferred form of the present invention will now be described, by way of example only, with reference to the accompanying drawings wherein.

DETAILED DESCRIPTION OF THE PREFERRED EMBODIMENT

Figure 1:
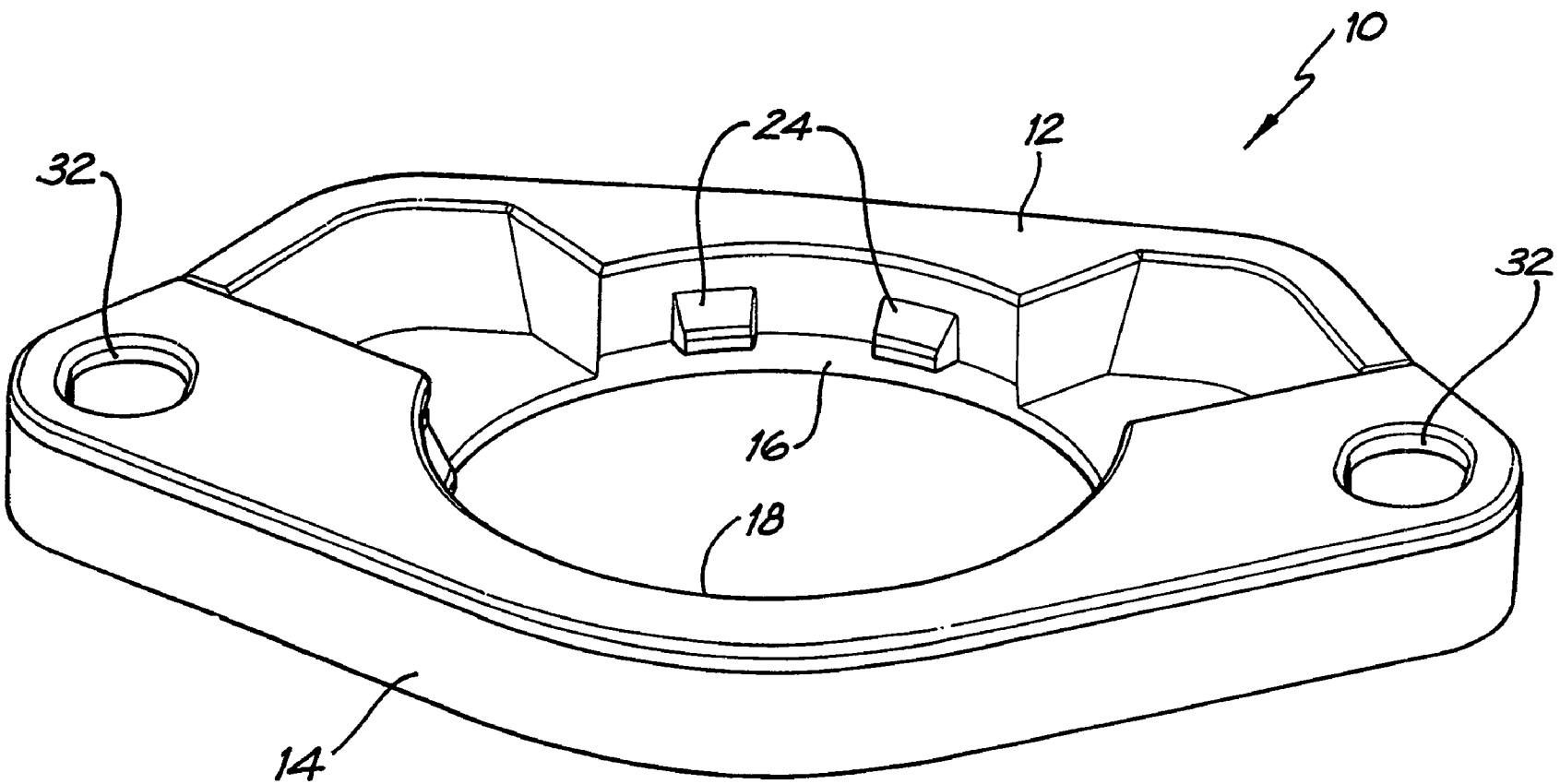
FIG. 1 is a perspective view of an embodiment of a cistern outlet valve mounting bracket assembly according to the invention.
Figure 2:
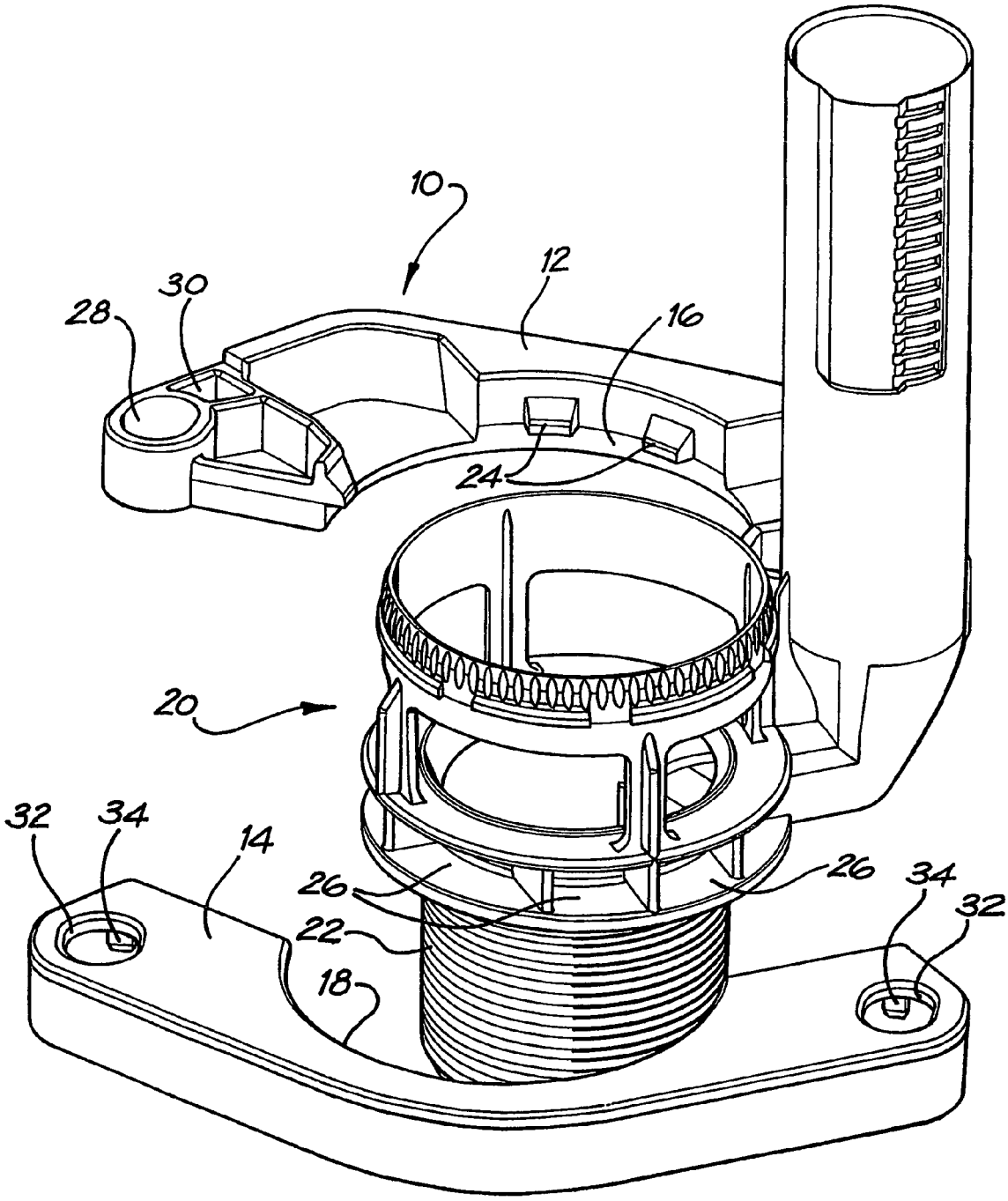
FIG. 2 is an exploded perspective view of the assembly shown in FIG. 1 prior to engagement with a cistern outlet valve.

Referring firstly to FIG. 1, there is shown an embodiment of a cistern outlet valve mounting bracket assembly 10 according to the invention. The assembly 10 includes first and second moulded, glass-filled nylon bracket members 12 and 14. The members 12, 14 each include a semi circular recess 16, 18 respectively which are each adapted to receive a portion of a substantially cylindrical outlet valve 20 therein. The valve 20 has a tail 22. The recesses 16, 18 include teeth 24 which are adapted to engage with corresponding openings 26 (as best seen in FIG. 2) in the valve 20.

Figure 3:
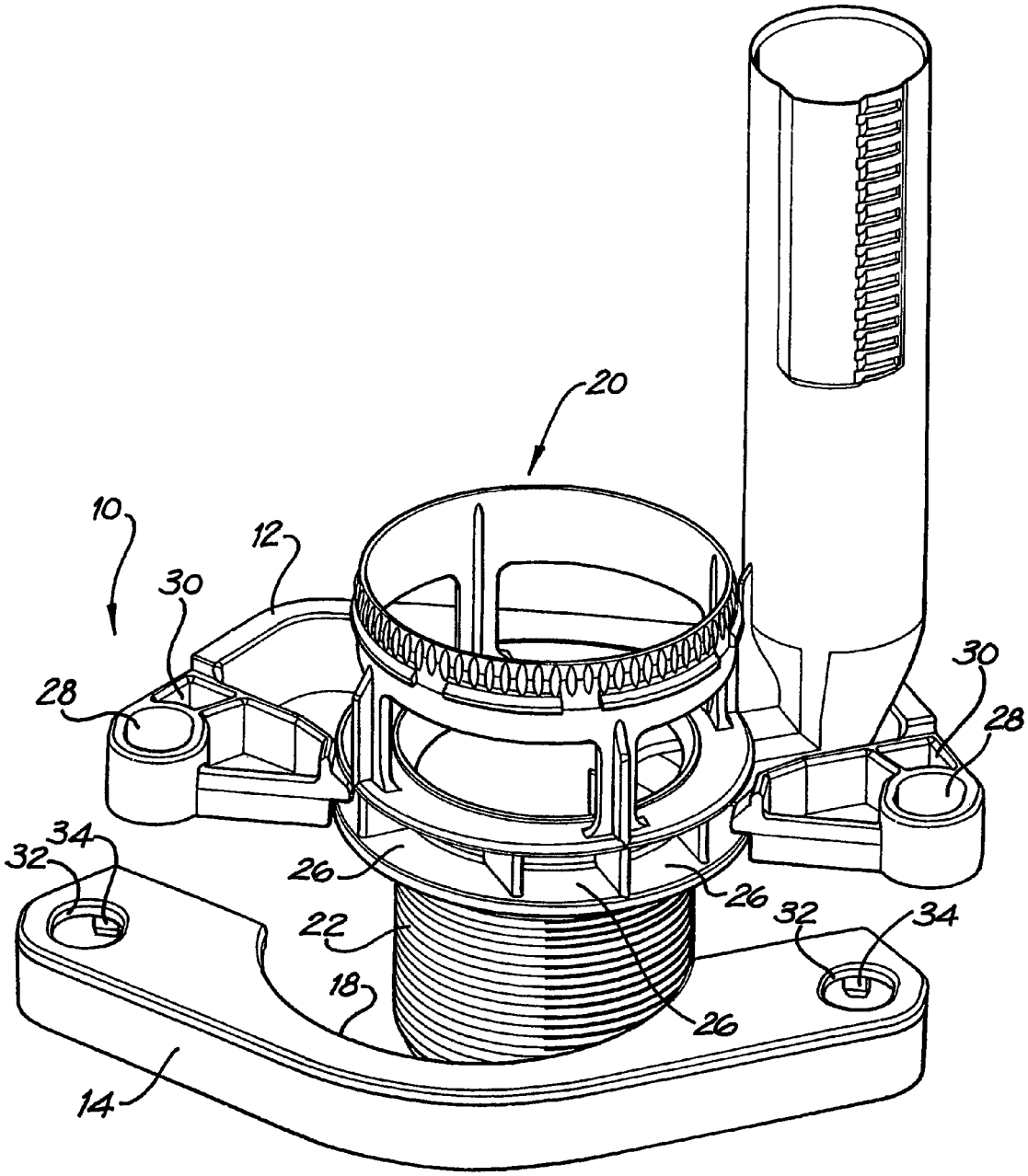
FIG. 3 is a perspective view of the assembly shown in FIG. 1 partially engaged with a cistern outlet valve.

As best shown in FIG. 3, the first member 12 includes two shaft portions 28 and recesses 30. The second member 14 includes a two corresponding apertures 32 and barbs 34. When the members 12,14 are brought together (see FIG. 4) about the valve 20, the barbs 34 engage with the recesses 30 in a position in which the apertures 32 align with the shaft portions 28 and the teeth 24 enter the openings 26.

Figure 4:
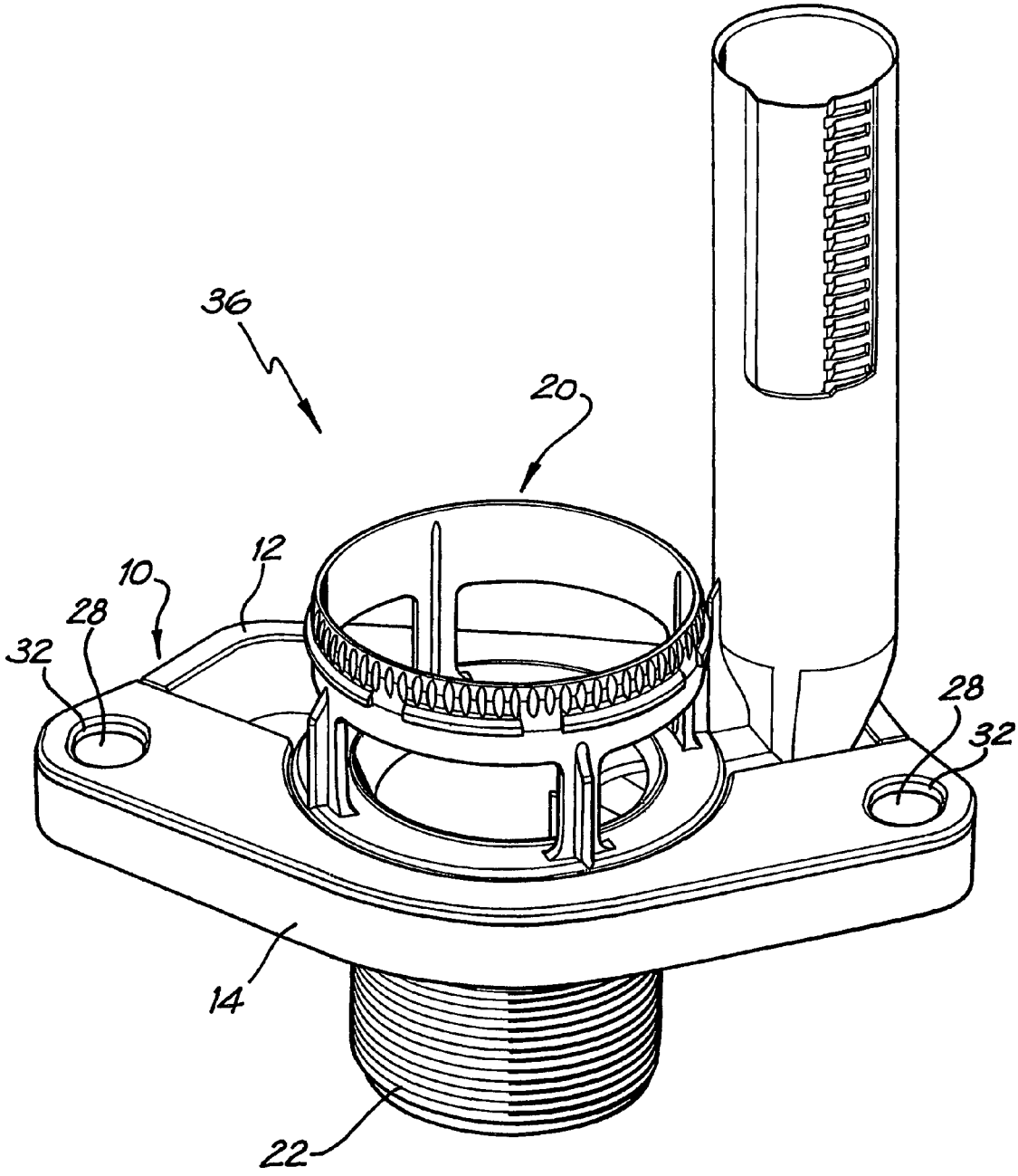
FIG. 4 is a perspective view of the assembly shown in FIG. 1 after engagement with an outlet valve.
Figure 5:
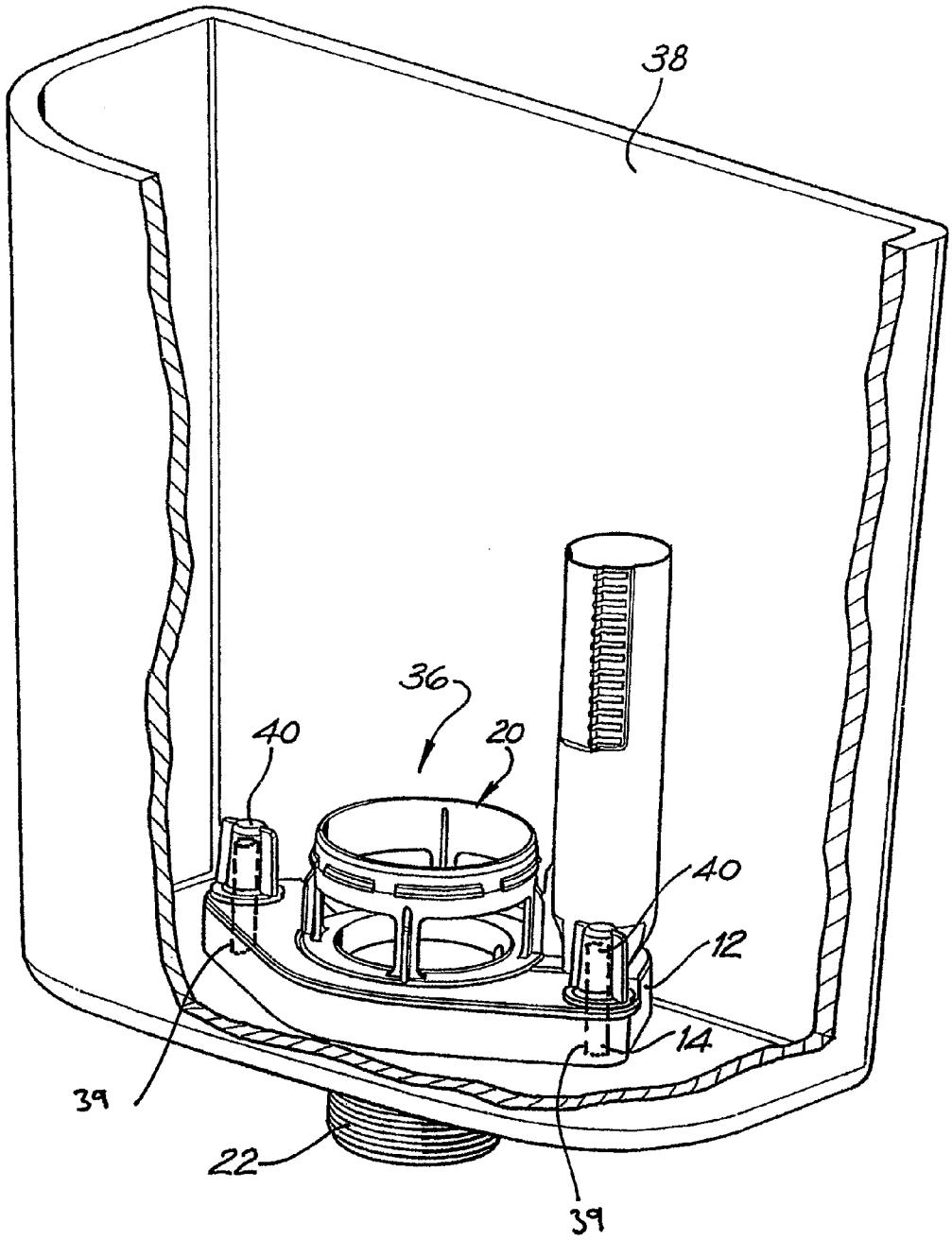
FIG. 5 is a perspective view of the assembly and valve shown in FIG. 4 installed within a cistern.

The installation of the assembly 10 shall now be described. FIGS. 2, 3 and 4 show sequentially how the members 12 and 14 are brought into engagement with one another about the outlet valve 20 until they ultimately engage each other, and also the outlet valve 20, to form the valve/assembly 36. FIG. 5 shows the valve/assembly 36 installed within a cistern 38 by passing the tail 22 of the valve 20 through an opening (not shown) in the base of the cistern 38 whilst passing the shaft portions/apertures 28/32 over a correspondingly positioned pair of fixing shafts, in the form of captive bolts 39. The assembly/valve 36 is fixed to the cistern 38 by fastening a pair of wingnuts 40 to the bolts 39.

A seal (not shown) is positioned between the adjacent surfaces of the interior of the cistern 38 and the exterior of the valve/assembly 36.

It should be noted that the installation in FIG. 5 is shown in relation to a separate cistern for ease of description only. The preferred use of the outlet valve mounting bracket assembly is in mounting an outlet valve to a cistern forming part of a one piece toilet suite.

The assembly described above has several advantages over the prior art arrangements. Firstly, the installation of the assembly and the valve described results in only one potential leak path between the assembly/valve and the cistern. Secondly, the assembly may be inexpensively manufactured by injection moulding in a thermoplastic material, and can be quickly and easily installed into engagement with the outlet valve. Thirdly, the assembly can be used with an outlet valve which is also suitable for use in a toilet suite having a separate cistern and pan, thereby reducing production and inventory costs. Fourthly, the bracket enables an outlet valve to be fixed to the cistern in a manner allowing easy removal without requiring a nut on the (inaccessible) tail of the outlet valve.

Although the invention has been described with reference to a specific example, it would be appreciated by those skilled in the art that the invention may be embodied in many other forms.

The claims defining the invention are as follows:

1. A cistern outlet valve mounting bracket assembly, said assembly including first and second bracket members adapted for positioning about an outlet valve in engagement with each other and the valve, one of said first or second bracket members including a pair of hollow shaft portions and a pair of recesses, the other of said first or second bracket members including a pair of apertures and a pair of barbs, each of the barbs engaging with each of the respective recesses to engage the first and second bracket members and each of the hollow shaft portions aligning with each of the respective apertures to allow passage of a respective pair of fixing shafts through the pairs of aligned hollow shaft portions and apertures for fixing said first and second bracket members, when so engaged, to a cistern.

2. The assembly as claimed in claim 1, wherein the members each include a semi-circular recess, each adapted to receive a portion of the outlet valve therein.

3. The assembly as claimed in claim 2, wherein the recesses have teeth adapted to engage with corresponding openings in the outlet valve.

4. The assembly as claimed in claim 1, wherein the barbs are adapted to engage with the recesses substantially adjacent the shaft portions.

* * * * *

UNITED STATES PATENT AND TRADEMARK OFFICE

CERTIFICATE OF CORRECTION

PATENT NO. : 7,640,603 B2
APPLICATION NO. : 10/527264
DATED : January 5, 2010
INVENTOR(S) : Sam Robertson England It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 968 days.

Signed and Sealed this

Sixteenth Day of November, 2010

David J. Kappos

David J. Kappos
*Director of the United States Patent and Trademark Office*